US006488550B1

(12) United States Patent
Kikuchi et al.

(10) Patent No.: US 6,488,550 B1
(45) Date of Patent: Dec. 3, 2002

(54) CONNECTOR CONTACT AND METHOD OF MANUFACTURING THE SAME

(75) Inventors: Kazuya Kikuchi, Tokyo (JP); Toshiaki Nagafuji, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/598,318

(22) Filed: Jun. 21, 2000

(30) Foreign Application Priority Data

Jun. 25, 1999 (JP) ..... 11-180822

(51) Int. Cl.[7] ..... H01R 11/22
(52) U.S. Cl. ..... 439/857; 439/886
(58) Field of Search ..... 439/857, 862, 439/856, 886; 29/874

(56) References Cited

U.S. PATENT DOCUMENTS 3,812,452 A * 5/1974 Sturm ..... 439/857
5,208,978 A * 5/1993 Dixon et al. ..... 29/874

FOREIGN PATENT DOCUMENTS

| | | |
|---|---|---|
| JP | 60-117574 | 6/1985 |
| JP | 5-152051 | 6/1993 |

* cited by examiner

*Primary Examiner*—Tho D. Ta
*Assistant Examiner*—Ann McCamey
(74) *Attorney, Agent, or Firm*—Sughrue Mion, PLLC

(57) ABSTRACT

A connector contact includes a pair of contact arms, a contact support, and an external connecting terminal. The pair of contact arms are made of strips having a predetermined thickness and opposing end faces. The contact arms have flat contact surfaces, on inner sides of their distal end portions, which are formed by crushing the strips toward their end faces. The contact support supports the contact arms. The external connecting terminal projects from the contact support. A method of manufacturing a connector contact is also disclosed.

7 Claims, 6 Drawing Sheets

CONNECTOR CONTACT AND METHOD OF MANUFACTURING THE SAME

BACKGROUND OF THE INVENTION

The present invention relates to a connector contact suitably used in a multi-contact type connector, and a method of manufacturing the same.

Generally, as a connector contact used in a connector and the like, a fork contact, formed by punching a metal contact material by a press or the like and having two contact surfaces formed by plating respective plating target surfaces, is known.

FIG. 5 shows the schematic structure of a conventional fork contact disclosed in Japanese Patent Laid-Open No. 60-117574 (reference 1). Referring to FIG. 5, a U-shaped fork contact 51 has two contact arms 51*a* and 51*b* parallel to each other, a contact support 51*c* for supporting the two contact arms 51*a* and 51*b,* and an external connecting terminal 51d projecting from the contact support 51*c.*

The fork contact 51 having the above structure is manufactured in the following manner. First, a contact material made of a metal plate is punched to form a first contact forming piece 61 integrally having two contact arm forming portions 61*a* and 61*b* parallel to each other, a contact support 61*c* for supporting the two contact arm forming portions 61*a* and 61*b,* and an external connecting terminal 61*d* projecting from the contact support 61*c,* as shown in FIG. 6.

The distal end portions of the contact arm forming portions 61*a* and 61*b* of the first contact forming piece 61 are twisted by 90 degrees to form a second contact forming piece having opposing plating target surfaces (contact arm surfaces). The plating target surfaces of the second contact forming piece are plated to form contact surfaces. In this manner, the fork contact 51 shown in FIG. 5 is fabricated.

In the conventional fork contact 51 described above, since the plating target surfaces are opposed to each other by twisting the second contact forming piece, the external form width (dimensions from the left end of 61*a* to the right end of 61*b*) of the whole of the contact arm forming portions 61*a* and 61*b* must be set to be larger than that of the contact support 61*c.* As the plating target surfaces oppose each other during plating, when they are subjected to plating from the punched surface side (perpendicular to the sheet surface of 51*c*), the plating material undesirably attaches to portions other than the plating target surfaces such as the sheared surfaces.

As a result, the number of contact forming pieces obtained from one contact material decreases, and a large amount of plating material is necessary for plating, leading to an increase in manufacturing cost. As the second contact forming piece is subjected to twisting, it is difficult to keep the parallel degree between the contact surfaces, and the reliability of the machining precision decreases.

Japanese Patent Laid-Open No. 5-152051 (reference 2) disclosed a fork contact having L-shaped contact arms with distal end portions bent through 90 degrees. This structure, however, does not solve the problems described above.

SUMMARY OF THE INVENTION

It is an object of the present invention to provide a connector contact manufactured at a low cost, and a method of manufacturing the same.

It is another object of the present invention to provide a connector contact which can increase the reliability of the machining precision, and a method of manufacturing the same.

In order to achieve the above objects, according to the present invention, there is provided a connector contact comprising a pair of contact arms made of strips having a predetermined thickness and opposing end faces, the contact arms having flat contact surfaces, on inner sides of distal end portions thereof, which are formed by crushing the strips toward the end faces thereof, a contact support for supporting the contact arms, and an external connecting terminal projecting from the contact support.

DESCRIPTION OF THE PREFERRED EMBODIMENTS

The present invention will be described in detail with reference to the accompanying drawings.

Figure 1:
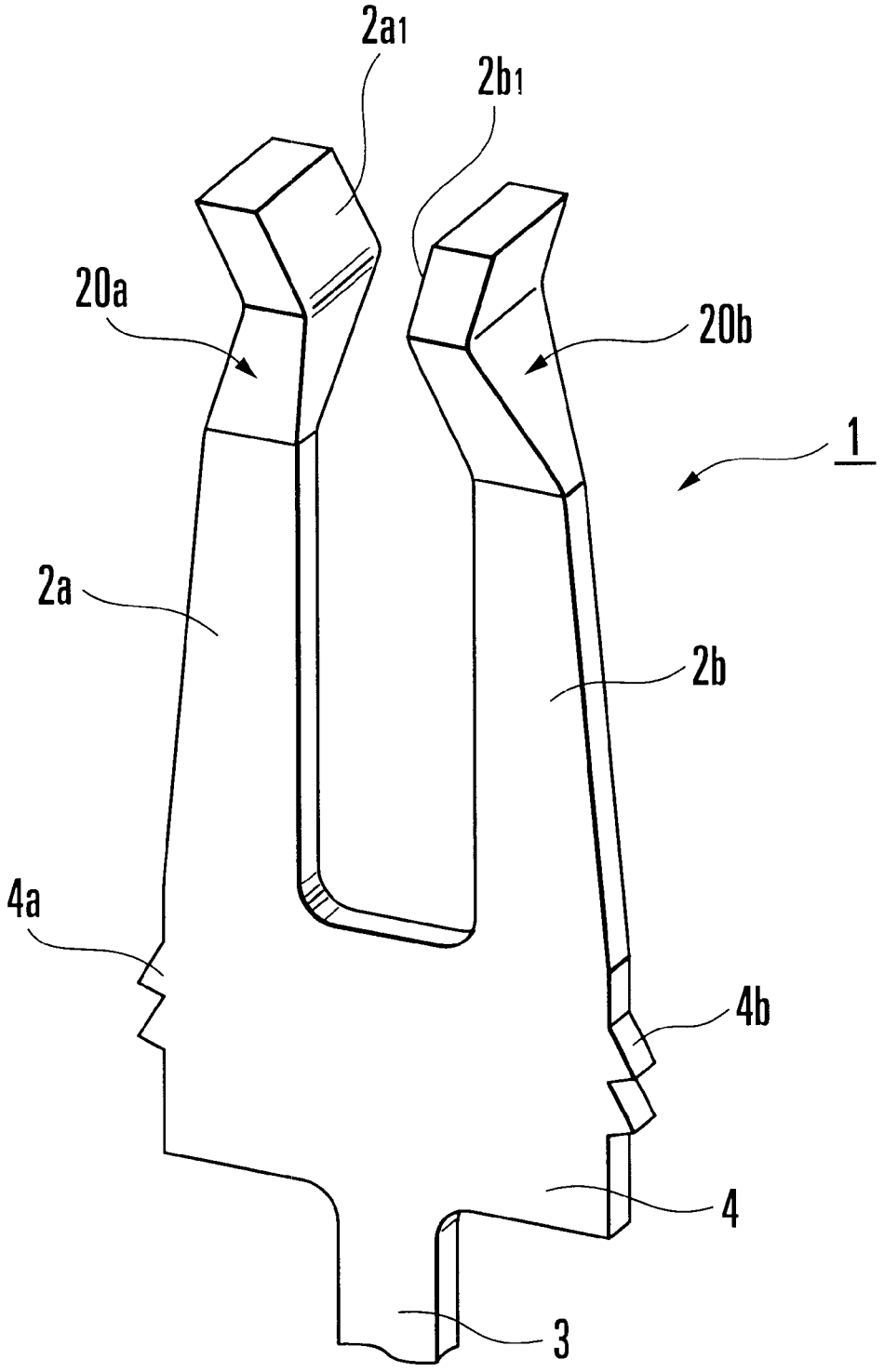
FIG. 1 is a perspective view showing a fork contact according to the first embodiment of the present invention.

FIG. 1 shows a fork contact according to the first embodiment of the present invention. Referring to FIG. 1, a fork contact 1 has a pair of contact arms 2*a* and 2*b* made of elastically deformable strips almost parallel to each other, a contact support 4 for supporting the contact arms 2*a* and 2*b,* and an external connecting terminal 3 formed on the contact support 4. The whole fork contact 1 is formed of a ductile and malleable conductive metal material such as copper.

Distal end portions 20*a* and 20*b* of the contact arms 2*a* and 2*b* are L-shaped by forming, and their rear portions are opposed to each other. Flat opposing contact surfaces 2*a*1 and 2*b*1 are formed on the inner end faces of the contact arms 2*a* and 2*b* by crushing, plating, and bending back a contact forming piece (not shown). The contact surfaces 2*a*1 and 2*b*1 are formed on the inner slant surfaces of the distal end portions 20*a* and 20*b* of the contact arms 2*a* and 2*b.*

The plating target surfaces of the contact surfaces 2*a*1 and 2*b*1 are plated with gold to stabilize contact and prevent corrosion. The contact forming piece is obtained by punching and bending a contact material formed of a conductive metal plate having a predetermined thickness. Projections 4*a* and 4*b* integrally project from the two end faces of the contact support 4 to lock the fork contact 1 in a connector housing (not shown).

A method of manufacturing the fork contact having the above arrangement will be described with reference to front views shown in FIGS. 2A to 2E and side views shown in FIGS. 3A to 3E.

Figure 2A:
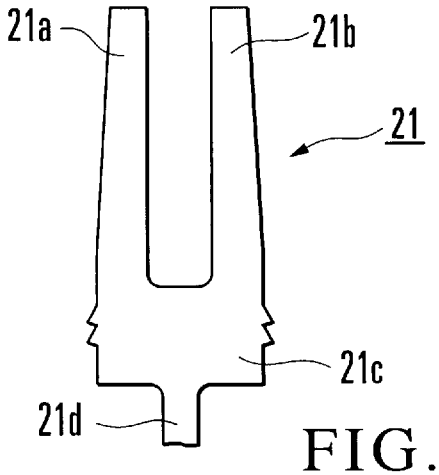
FIGS. 2A to 2E are front views of a contact forming piece to show the manufacturing process of the fork contact shown in FIG. 1.
Figure 3A:
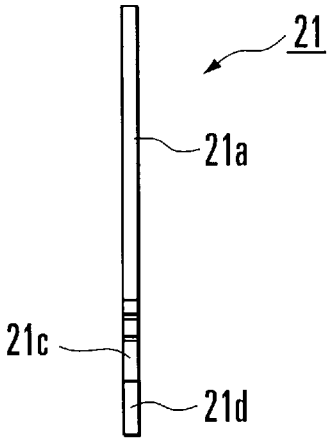
FIGS. 3A to 3E are side views of the contact forming piece to show the manufacturing process of the fork contact shown in FIG. 1.

As shown in FIGS. 2A and 3A, a copper contact material is punched to form a first contact forming piece 21 having two parallel contact arm forming portions 21*a* and 21*b,* a contact support 21*c* for supporting the contact arm forming portions 21*a* and 21*b*, and an external connecting terminal 21*d* projecting from the contact support 21*c*.

In this case, when punching the contact material, the contact width of each of the contact arm forming portions 21*a* and 21*b* is set to be smaller than that of the contact support 21*c*. In other words, the punching width of the contact material is set to be equal to the contact width of the contact support 21*c* at maximum.

Figure 2D:
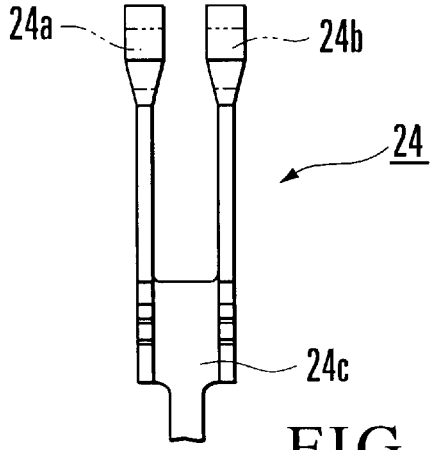
Figure 2B:
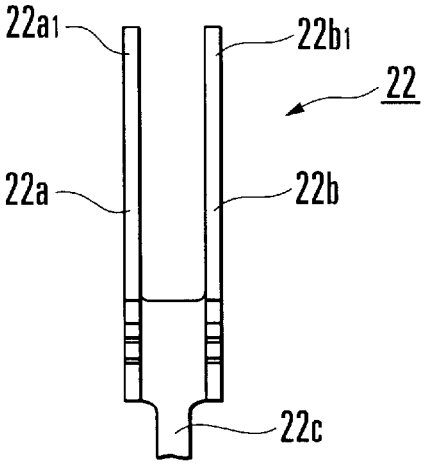

The two sides of the contact support 21*c* of the first contact forming piece 21 are bent at a right angle along the longitudinal direction of the contact. A second contact forming piece 22 with a square U-shaped cross section, having opposing contact arm forming portions 22*a* and 22*b*, is accordingly formed, as shown in FIGS. 2B and 3B. In this case, the first contact forming piece 21 is desirably bent by considering the tensile limit of the material not to produce an apparent crack or bending wrinkles, so that it can be bent back in the later process.

Figure 2E:
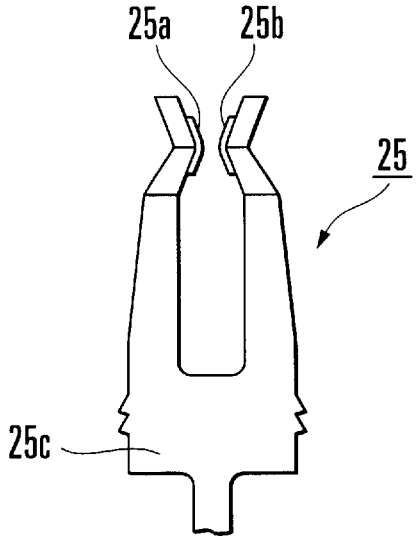
Figure 2C:
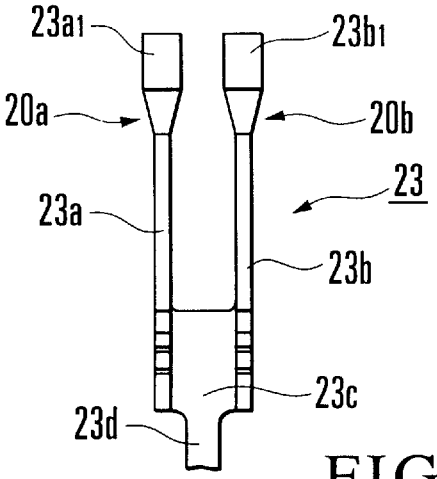
Figure 3D:
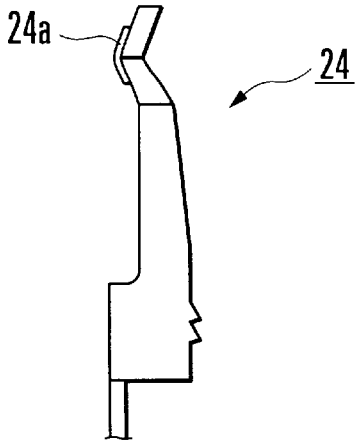
Figure 3B:
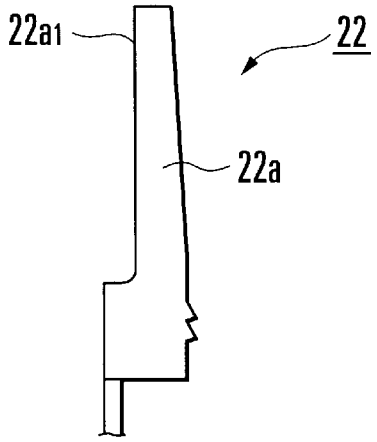
Figure 3E:
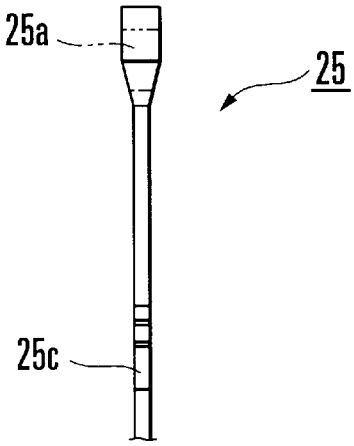
Figure 3C:
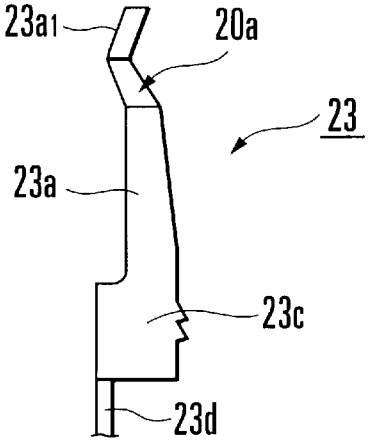

Crushing forces are applied to punched end faces (sheared surfaces) 22*a*1 and 22*b*1 of the distal end portions 20*a* and 20*b* of the contact arm forming portions 22*a* and 22*b* from the same side, and the crushed punched end faces 22*a*1 and 22*b*1 are subjected to forming, to form L-shaped contact arm forming portions 23*a* and 23*b* respectively having plating target surfaces 23*a*1 and 23*b*1, as shown in FIGS. 2C and 3C. Thus, a third contact forming piece 23 having the L-shaped contact arm forming portions 23*a* and 23*b* is formed.

Figure 4A:
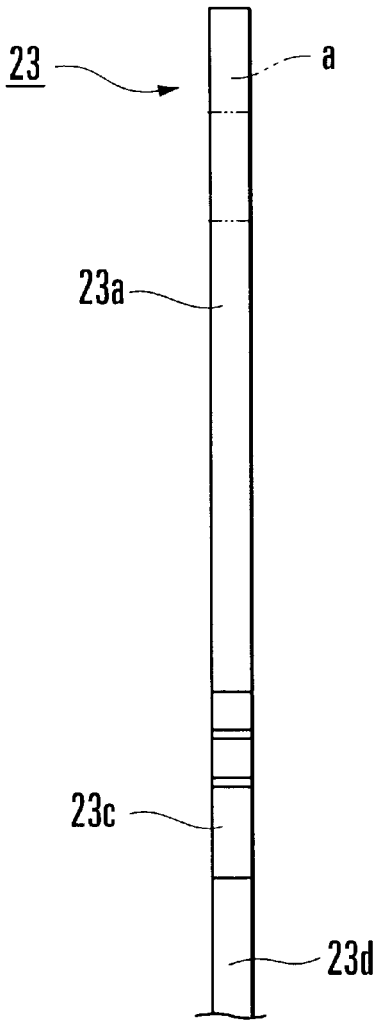
FIGS. 4A and 4B are side and front views, respectively, of a contact forming piece to show another embodiment of the manufacturing process of the fork contact shown in FIG. 1.
Figure 4B:
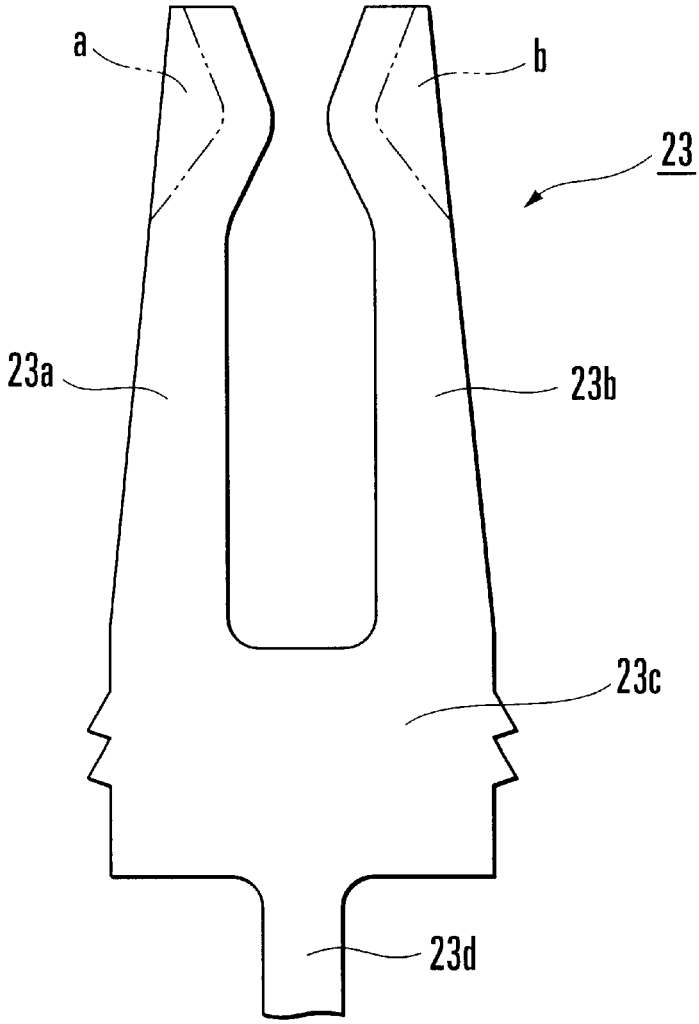
Figure 5:
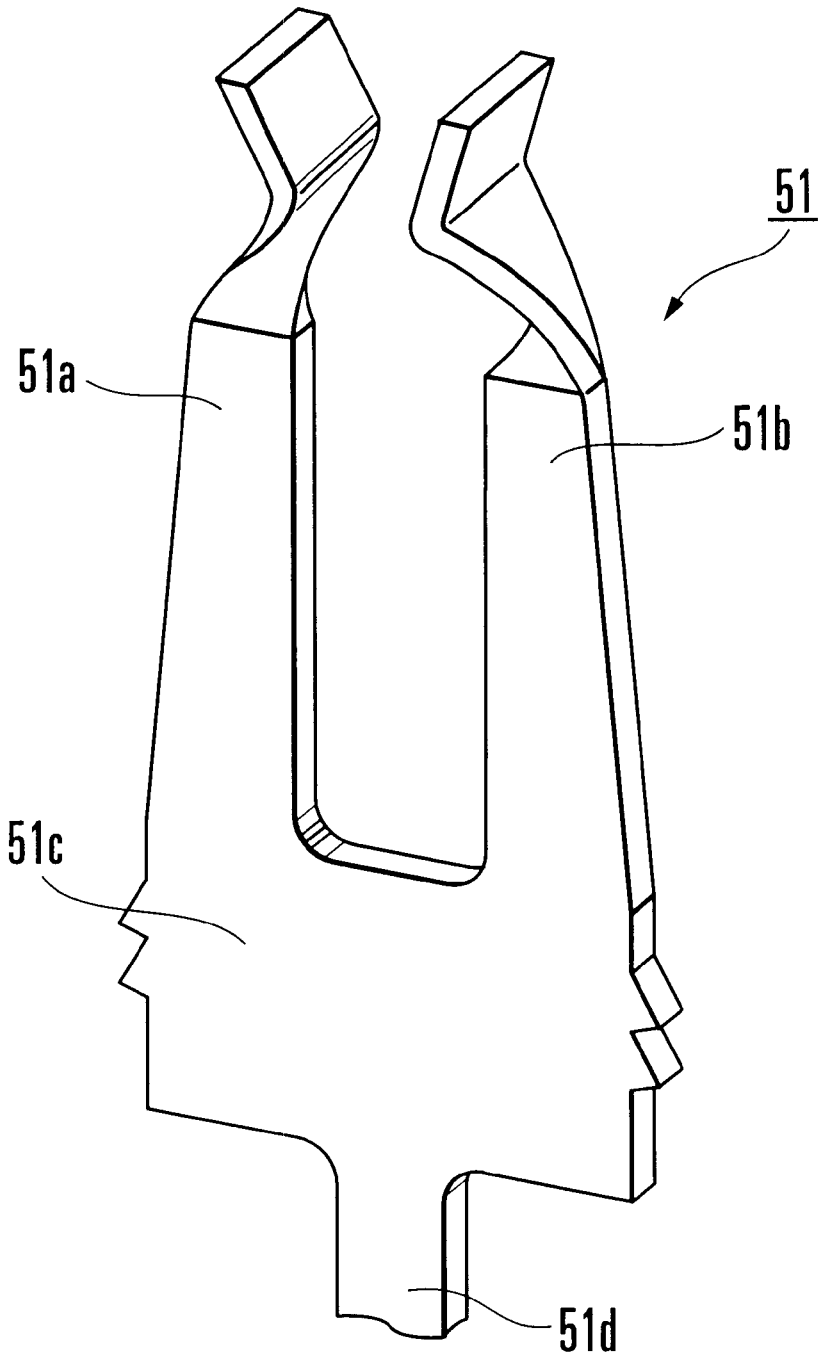
FIG. 5 PRIOR ART
FIG. 5 is a perspective view of a conventional fork contact.
Figure 6:
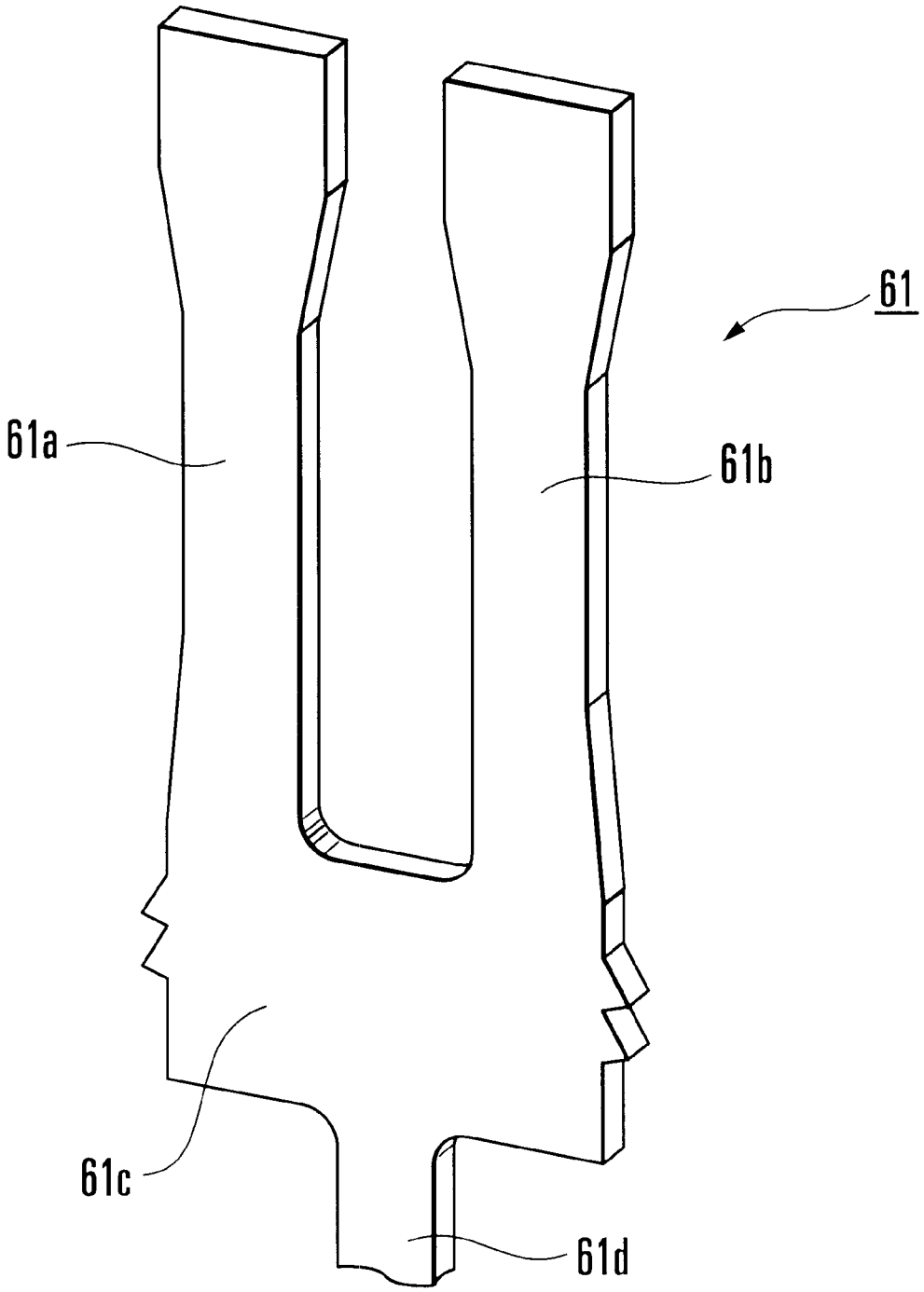
FIG. 6 PRIOR ART
FIG. 6 is a front view of a fork contact to show the manufacturing process of the fork contact shown in FIG. 5.

In this case, the contact material is punched in advance to match the formed shape obtained after forming the third contact forming piece 23, as shown in FIGS. 4A and 4B (portions indicated by alternate long and two short dashed lines a and b are punched). Hence, forming (forming into an L-shape) in the forming process for the third contact forming piece 23 is partly omitted.

If the contact arm forming portions 23*a* and 23*b* of the contact material have a thickness larger than that of each of a contact support 23*c* and external connecting terminal 23*d*, when forming the third contact forming piece 23, the crushing amount for the contact arm forming portions 23*a* and 23*b* decreases, and high shape precision of the contact portions and high smoothness of the contact surfaces can be obtained easily.

The crushing amount for the contact arm forming portions 23*a* and 23*b* is determined by considering the contact width and the fact that the crushed surfaces form plating target surfaces (smooth surfaces) after the manufacture.

Thereafter, the plating target surfaces 23*a*1 and 23*b*1 of the third contact forming piece 23 are plated with gold (Au) to form a fourth contact forming piece 24 having a pair of contact surfaces 24*a* and 24*b*, as shown in FIGS. 2D and 3D. In this case, since the plating target surfaces 23*a*1 and 23*b*1 face the same side, they are plated easily.

The two sides of a contact support 24*c* of the fourth contact forming piece 24 are bent back to form a fifth contact forming piece 25 having a pair of opposing contact surfaces 25*a* and 25*b*, as shown in FIGS. 2E and 3E. Subsequently, a contact support 25*c* of the fifth contact forming piece 25 is subjected to forming to form a sixth contact forming piece (not shown) having a smooth contact support (not shown). The manufacture of the connector contact is completed in this manner.

In this embodiment, as shown in FIGS. 2A to 2E and FIGS. 3A to 3E, the plating target surfaces 23*a*1 and 23*b*1 serving as the contact surfaces 25*a* and 25*b* are formed by applying crushing pressures to the punched end faces 22*a*1 and 22*b*1 of the contact arm forming portions 22*a* and 22*b* from the same side after a contact support 22*c* is bent. Since the contact support 24*c* is bent back after plating the plating target surfaces, the pair of contact surfaces 25*a* and 25*b* oppose each other. When performing punching, the width of each of the contact arm forming portions 21*a* and 21*b* is set to be smaller than that of the contact support 21*c*, and a large number of contact forming pieces can be accordingly obtained from one contact material.

Since the pair of opposing contact surfaces 25*a* and 25*b* can be obtained by bending (bending back) the contact forming piece, the parallel degree between them can be maintained easily. Since the plating target surfaces 23*a*1 and 23*b*1 face the same side, plating can be performed only to them during plating.

In this embodiment, the second contact forming piece 22 is formed by bending the first contact forming piece 21 into a square U-shape. The present invention is not limited to this, but the second contact forming piece 22 can be formed by bending the first contact forming piece 21 into a U shape.

As has been described above, according to the present invention, opposing contact surfaces are formed by sequentially crushing, plating, and bending back the inner end faces of a pair of contact arms. Therefore, the contact width of each contact arm forming portion is set smaller than that of the contact support. Also, since the plating target surfaces face the same side during plating, plating is performed only to them.

Therefore, a large number of contact forming pieces can be punched from one contact material, and plating can be done with a small amount of plating material, so that the manufacturing cost can be reduced.

Since a pair of opposing contact surfaces can be obtained by bending back a contact forming piece, the parallel degree between them can be maintained easily, and reliability of the machining precision can be increased.

What is claimed is:

1. A connector contact comprising:

a pair of contact arms made of strips having a predetermined thickness and predetermined width;

said contact arms having distal ends where the thickness of said distal end is greater than said predetermined thickness, and the width of said distal end is less than said predetermined width;

said distal ends having opposing inner faces, said inner faces having at least partially planar contact surfaces;

a contact support for supporting said contact arms;

an external connecting terminal projecting from said contact support; and said contact arms further comprise major portions which extend from said contact support to said distal ends, wherein said major portions have a substantially constant thickness along their direction of extension.

2. A contact according to claim 1, wherein said contact arms are made of an elastic conductive metal.

3. A contact according to claim 1, wherein:

said distal end portions of said contact arms are L-shaped;

said L-shapes comprised of a first surface angled inward toward said opposing distal end, and inner slant surface continuing distally from said first surface, angled outward from said opposing distal end; and said contact surfaces are formed on said inner slant surfaces of said distal end portions of said contact arms.

4. A contact according to claim 1, further comprising gold plating layers formed on said contact surfaces.

5. A connector contact as claimed in claim 1, wherein said contact surfaces comprise inner slant surfaces of the distal end portions of the contact arms.

6. A connector contact comprising:

a pair of contact arms made of strips having a predetermined thickness and predetermined width;

said contact arms having distal ends where the thickness of said distal end is greater than said predetermined thickness, and the width of said distal end is less than said predetermined width;

said distal ends having opposing inner faces, said inner faces having at least partially flat contact surfaces along their length and width;

a contact support for supporting said contact arms;

an external connecting terminal projecting from said contact support; and said contact arms further comprise major portions which extend from said contact support to said distal ends, wherein said major portions have a substantially constant thickness along their direction of extension.

7. A connector contact comprising:

a pair of contact arms made of strips having a predetermined thickness and predetermined width;

said contact arms having distal ends where the thickness of said distal end is greater than said predetermined thickness, and the width of said distal end is less than said predetermined width;

said distal ends having opposing inner faces, said inner faces having flat contact surfaces;

a contact support for supporting said contact arms;

an external connecting terminal projecting from said contact support; and said contact arms further comprise major portions which extend from said contact support to said distal ends, wherein said major portions have a substantially constant thickness along their direction of extension;

wherein said contact arms are made of an elastic conductive metal;

further wherein said distal end portions of said contact arms are L-shaped, said L-shapes comprised of a first surface angled inward toward said opposing distal end, and inner slant surface continuing distally from said first surface, angled outward from said opposing distal end; and said contact surfaces are formed on said inner slant surfaces of said distal end portions of said contact arms further comprising gold plating layers formed on said contact surfaces.

* * * * *